US007217097B2

(12) United States Patent
Liang

(10) Patent No.: US 7,217,097 B2
(45) Date of Patent: May 15, 2007

(54) COOLING SYSTEM WITH INTERNAL FLOW GUIDE WITHIN A TURBINE BLADE OF A TURBINE ENGINE

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 162 days.

(21) Appl. No.: 11/031,793

(22) Filed: Jan. 7, 2005

(65) Prior Publication Data

US 2006/0153678 A1 Jul. 13, 2006

(51) Int. Cl.
*F01D 5/18* (2006.01)

(52) U.S. Cl. ..... 416/97 R

(58) Field of Classification Search ..... 415/115; 416/96 R, 97 R

See application file for complete search history.

(56) References Cited

U.S. PATENT DOCUMENTS

| | | | | |
|---|---|---|---|---|
| 4,820,122 | A * | 4/1989 | Hall et al. | 416/97 R |
| 5,232,343 | A | 8/1993 | Butts | |
| 5,403,159 | A * | 4/1995 | Green et al. | 416/97 R |
| 5,498,126 | A | 3/1996 | Pighetti et al. | |
| 5,507,621 | A | 4/1996 | Cooper | |
| 5,511,309 | A * | 4/1996 | Beabout | 29/889.72 |
| 5,669,759 | A | 9/1997 | Beabout | |
| 5,772,397 | A | 6/1998 | Morris et al. | |
| 5,967,752 | A | 10/1999 | Lee et al. | |
| 5,971,708 | A | 10/1999 | Lee | |
| 6,033,181 | A | 3/2000 | Endres et al. | |
| 6,132,169 | A | 10/2000 | Manning et al. | |
| 6,227,804 | B1 | 5/2001 | Koga et al. | |
| 6,257,831 | B1 | 7/2001 | Papple et al. | |
| 7,118,325 | B2 * | 10/2006 | Kvasnak et al. | 415/115 |
| 2004/0076519 | A1 | 4/2004 | Halfmann et al. | |
| 2004/0115053 | A1 | 6/2004 | Shi et al. | |
| 2004/0208744 | A1 | 10/2004 | Shi et al. | |

FOREIGN PATENT DOCUMENTS

| | | | |
|---|---|---|---|
| JP | 10339104 | A | 12/1998 |

* cited by examiner

*Primary Examiner*—Edward K. Look
*Assistant Examiner*—Nathan Wiehe

(57) ABSTRACT

A turbine blade for a turbine engine having a cooling system in the turbine blade formed from at least one cooling channel. The cooling channel may be a serpentine cooling channel with a flow guide extending from a first turn to a second turn of the cooling channel and formed from a first turn section, a second turn section, and a body coupling the first and second turn sections together. The flow guide substantially eliminates separation of cooling fluid flow in the tip region of the cooling channel, thereby increasing heat transfer. In at least one embodiment, the flow guide extends from a first turn in the cooling channel proximate to the blade tip to a second turn proximate to a root of the blade.

19 Claims, 4 Drawing Sheets

COOLING SYSTEM WITH INTERNAL FLOW GUIDE WITHIN A TURBINE BLADE OF A TURBINE ENGINE

FIELD OF THE INVENTION

This invention is directed generally to turbine blades, and more particularly to the components of cooling systems located in hollow turbine blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades, as shown in FIG. 1, are formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The inner aspects of most turbine blades, as shown in FIG. 2, typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

Some conventional turbine blades incorporate serpentine cooling channels for directing cooling fluids through internal aspects of a turbine blade. Often times, the channels forming the cooling channels are nearly equal in cross-sectional area. The cooling channel proximate to the leading edge has a chordwise cross-section with a generally triangular shape. The apex of the triangular shaped cooling channel is the leading edge of the turbine blade. The configuration of the cross-sectional area negatively affects the distribution of cooling fluids to the leading edge and reduces the cooling fluid flow velocity as well as the internal heat transfer coefficient.

Other conventional cooling systems have attempted to overcome the negative impacts of the shape of the cross-section of the leading edge cooling channel by decreasing the size of the leading edge cooling channel relative to the downstream return cooling channel, as shown in FIG. 2. In short, the central rib has been shifted closer to the leading edge, thereby resulting in a leading edge cooling channel having a reduced cross-sectional area. The reduced cross-sectional area in the leading edge cooling channel increases the velocity of the cooling fluids, but causes the separation of cooling fluid flow in the tip region and a temperature increase at the blade tip. Therefore, while the reduced cross-sectional area of the leading edge cooling channel reduces the temperature at the leading edge, the temperature in the tip region has increased. Thus, a need exists for a cooling system for a turbine blade with a serpentine cooling channel that has increased heat transfer capabilities.

SUMMARY OF THE INVENTION

This invention relates to a turbine blade cooling system formed from at least one cooling channel having a flow guide positioned in the cooling channel extending from a first turn to a second turn in the cooling channel. In at least one embodiment, the cooling channel may be a configured as a serpentine cooling channel, such as, but not limited to, a triple pass serpentine cooling channel. The flow guide may include a first turn section positioned in a first turn of the cooling channel, a second turn section positioned in a second turn of the cooling channel, and a flow guide body extending from the first turn section to the second turn section. The flow guide eliminates blade tip section flow separation thereby greatly enhancing the blade tip region cooling and reducing blade tip turn pressure loss while providing support to the mid-chord region and improving cooling fluid flow characteristics through the blade root turn. The turbine blade may be formed from a generally elongated blade having a leading edge, a trailing edge, a tip at a first end, a root coupled to the blade at an end generally opposite the first end for supporting the blade and for coupling the blade to a disc, and at least one serpentine cooling channel forming the cooling system in the blade.

The first turn section of the flow guide may be positioned in the first turn of the cooling channel such that a leading end of the flow guide may extend closer to the leading edge of the turbine blade. The first turn section, in at least one embodiment, may be formed from a section that is generally parallel to the tip of the blade and may include a radius portion that couples the first turn section to the flow guide body. In at least one embodiment, the second turn section, which is downstream from the first root turn section, may include a trailing end positioned closer to the trailing edge than the second rib forming a portion of the cooling channel. The second turn section may be formed in the shape of quarter circle or other configuration redirecting the flow of cooling fluids with minimal pressure loss. In at least one embodiment, the flow guide may be positioned in the cooling channel generally equidistant from the first and second ribs forming the cooling channel.

During operation, cooling fluids flow into the cooling system from the root. At least a portion of the cooling fluids enter the cooling channel and pass through an outflow section of the cooling channel at a high flow velocity, thereby generating a high internal heat transfer coefficient and impingement. The cooling flow is then divided into two flow streams as the cooling fluids encounter the leading end of the flow guide. A portion of the cooling fluids accelerates and enters the outer flow path and impinges on the inner surface of the blade tip. The cooling fluids also impinge onto the inner surface of the blade tip near the trailing edge of the blade before flowing in the direction of the blade root. The outer flow path may receive a disproportionately larger amount of the cooling fluids, which causes corners in the first turn to receive more cooling fluids. The cooling fluids flow on either side of the flow guide through the mid-chord region of the cooling channel. The flow guide provides support to the mid-chord region while directing the cooling fluids to the second turn. As the cooling fluids enter the second turn, the configuration of the flow guide in the root turn provides a smooth cooling flow for a large root turn, thereby reducing the root section turn loss.

An advantage of this invention is that the flow guide eliminates the cooling fluid separation problem that exists in conventional cooling channels and effectively cools the first turn of the cooling channel.

Another advantage of this invention is that flow guide reduces the blade tip turn pressure loss while providing mid-chord region support.

Yet another advantage of this invention is that the flow guide improves the cooling fluid flow characteristics through the turbine blade root turn.

Still another advantage of this invention is that the flow guide increases the amount of heat transfer in the cooling system by causing cooling fluids to impinge on the leading edge of the flow guide and to impinge on the aft corner of the turbine blade tip before exiting from the root turn. The combination of reduced cooling fluid flow separation and the impingement cooling greatly increase the cooling in the tip of the blade.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
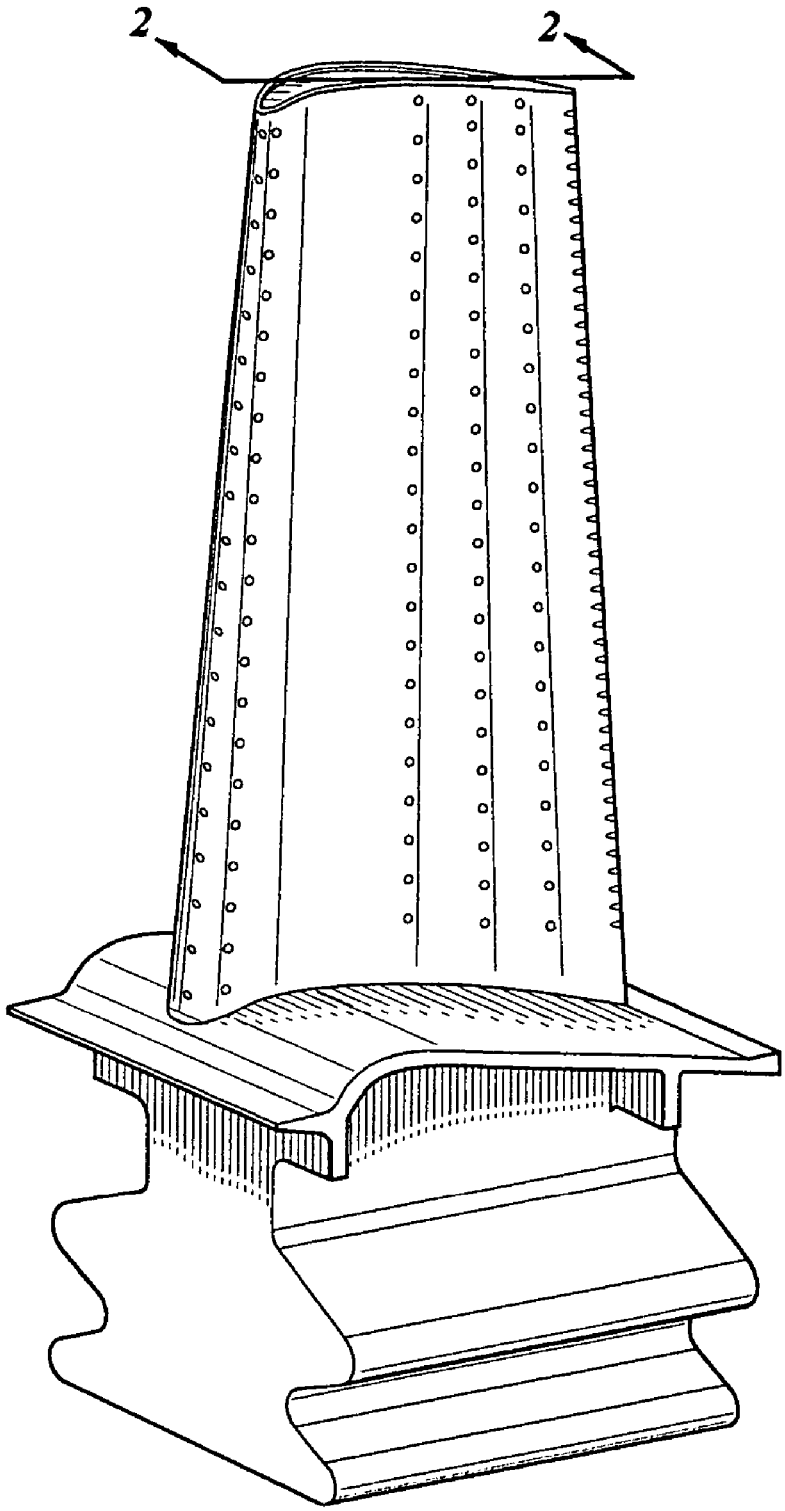
FIG. 1 (Prior Art)
FIG. 1 is a perspective view of a conventional turbine blade having features according to the instant invention.
Figure 2:
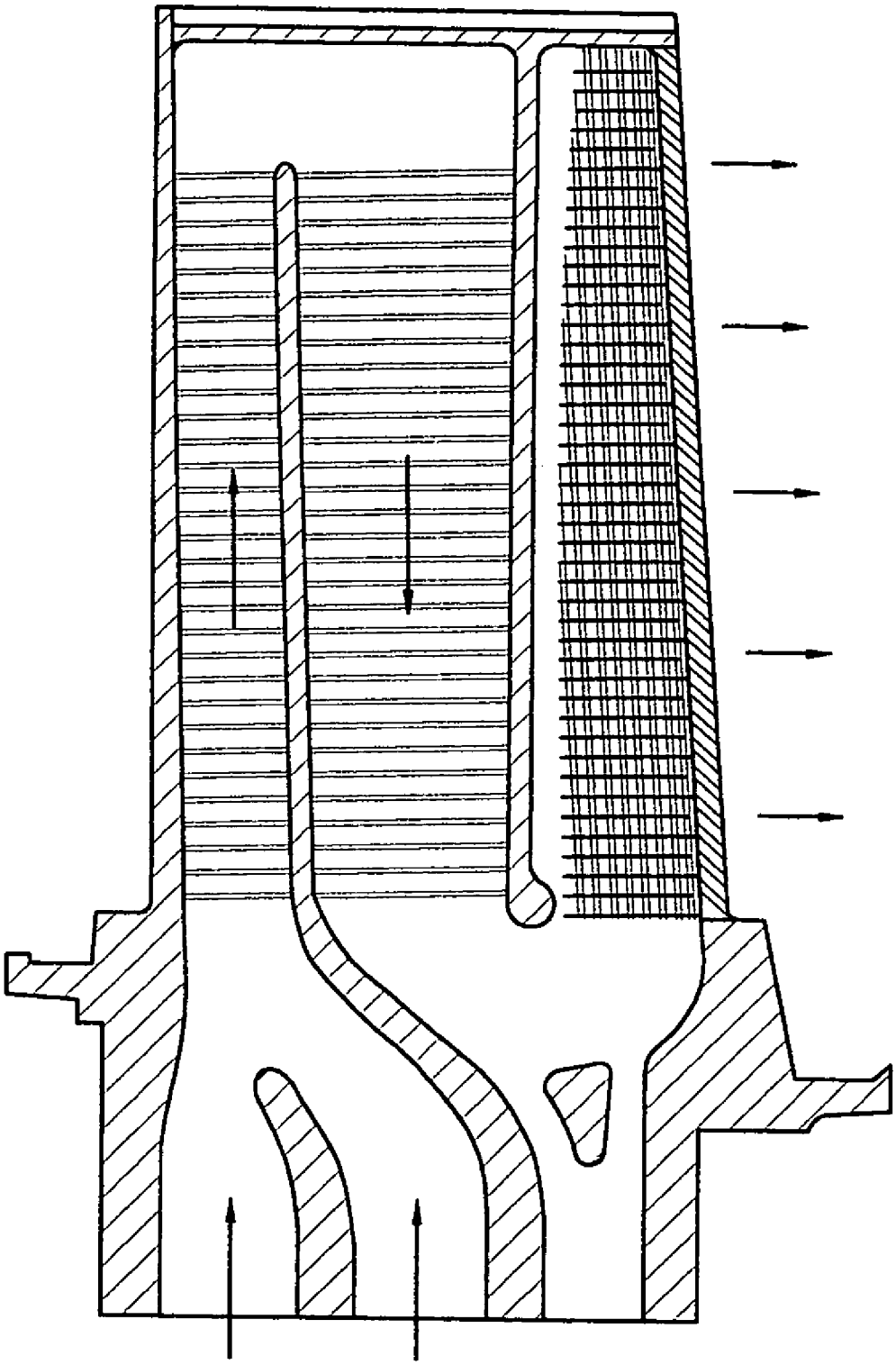
FIG. 2 (Prior Art)
FIG. 2 is cross-sectional view, referred to as a filleted view, of the conventional turbine blade shown in FIG. 1.
Figure 3:
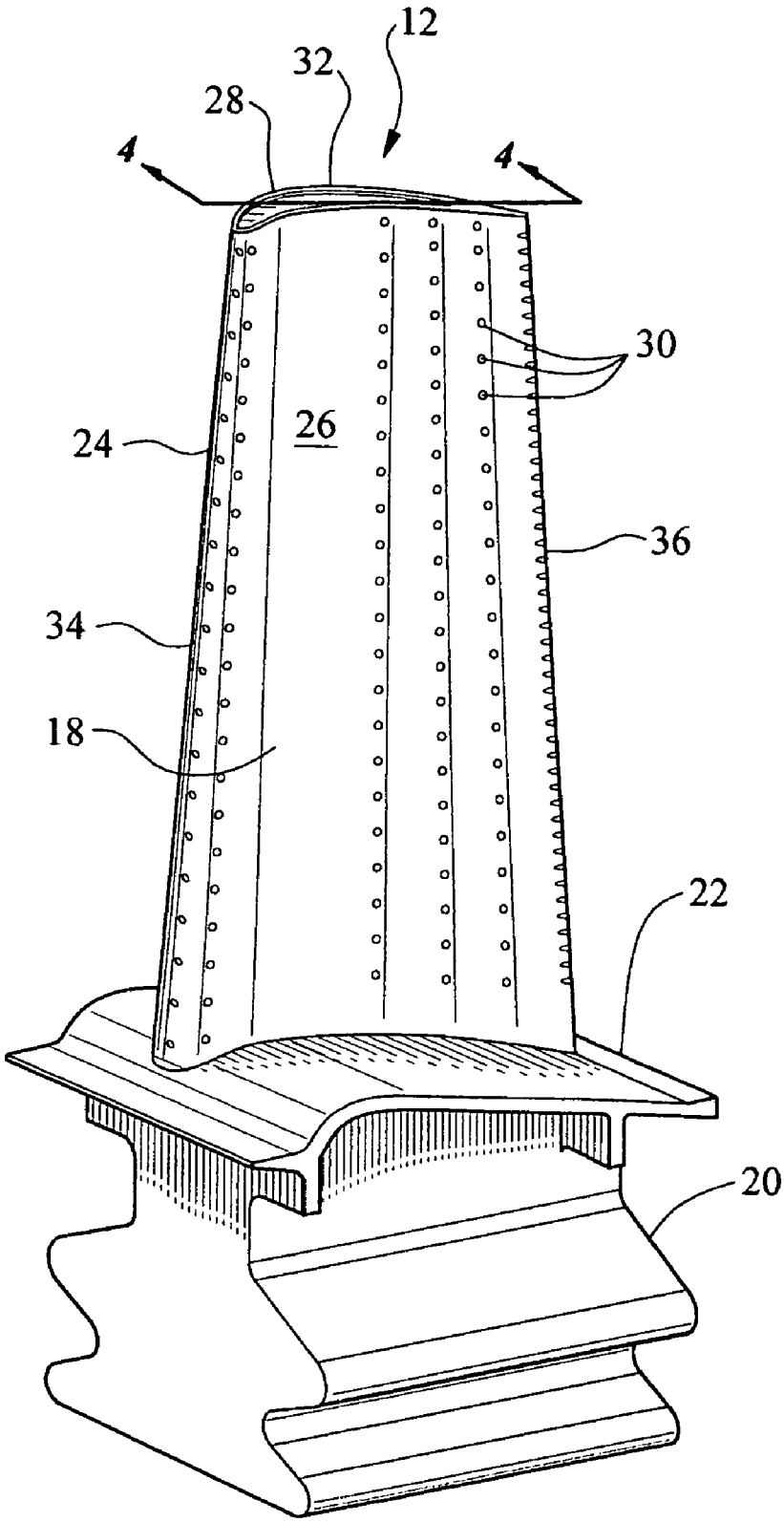
FIG. 3 is a perspective view of a turbine blade having features according to the instant invention.
Figure 4:
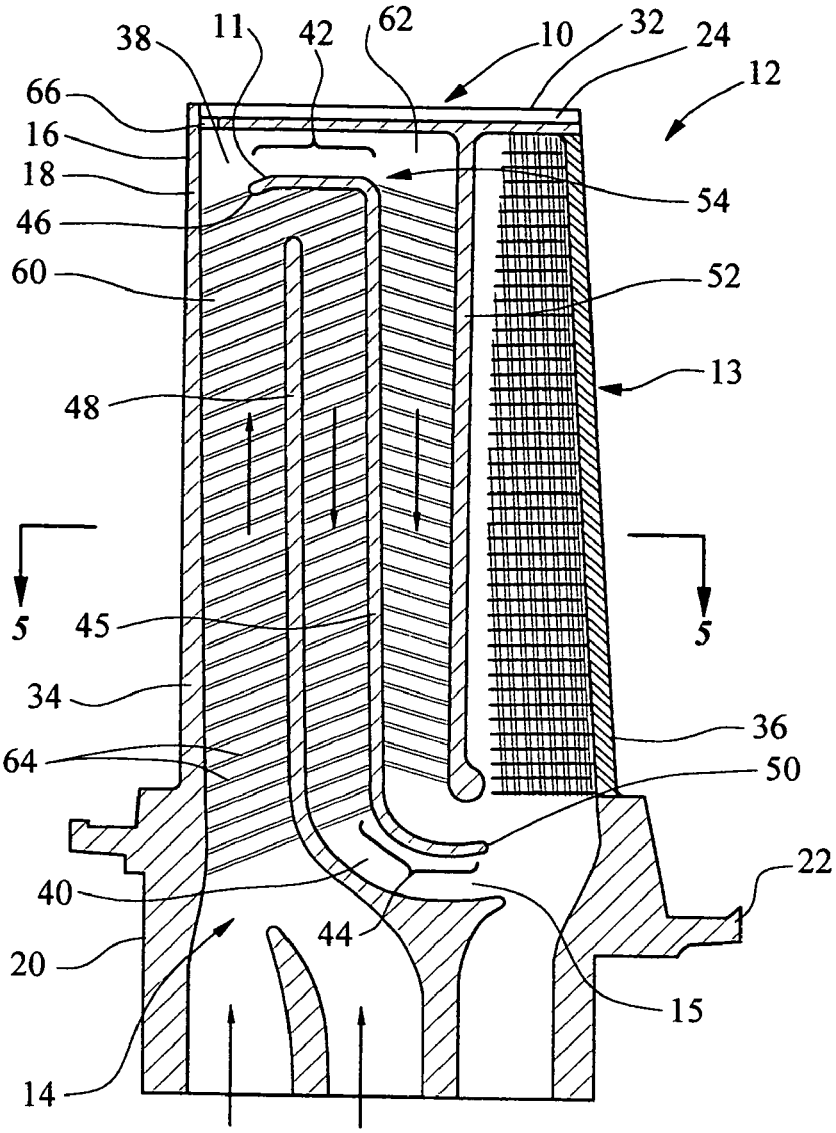
FIG. 4 is cross-sectional view, referred to as a filleted view, of the turbine blade shown in FIG. 3 taken along line 4—4.
Figure 5:
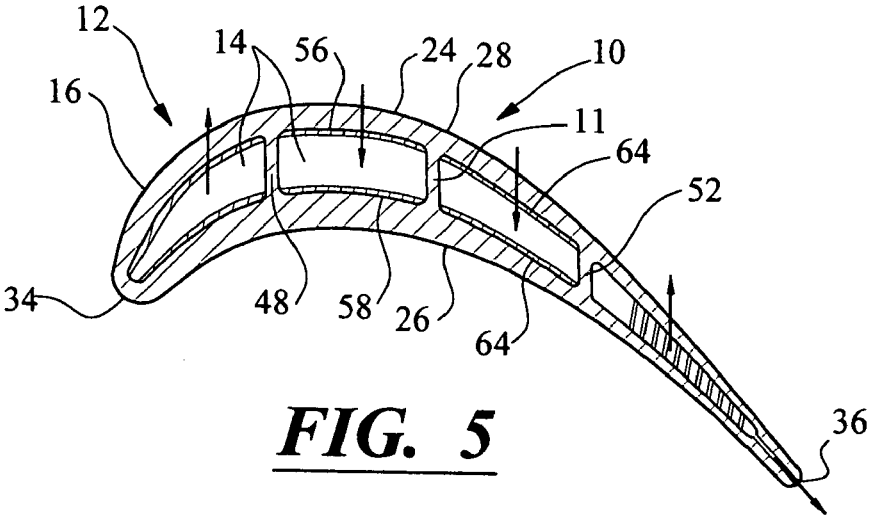
FIG. 5 is a partial cross-sectional view of the turbine blade shown in FIG. 4 taken along line 5—5.

As shown in FIGS. 3–5, this invention is directed to a turbine blade cooling system 10 for turbine blades 12 used in turbine engines. In particular, the turbine blade cooling system 10 is directed to a cooling system 10 formed at least from a cooling channel 14, as shown in FIG. 2, positioned between two or more walls forming a housing 16 of the turbine blade 12. In at least one embodiment, the cooling channel 14 may be formed from a serpentine cooling chamber, and may be, as shown in FIGS. 4 and 5, a triple pass cooling chamber. The cooling system 10 may include a flow guide 11 positioned in the cooling channel 14 for enhancing tip region cooling, reducing turbine blade tip turn pressure loss, providing mid-chord region 13 support, and improving flow characteristics in the blade root turn 15.

As shown in FIG. 3, the turbine blade 12 may be formed from a generally elongated blade 18 coupled to the root 20 at the platform 22. Blade 18 may have an outer wall 24 adapted for use, for example, in a first stage of an axial flow turbine engine. Outer wall 24 may having a generally concave shaped portion forming pressure side 26 and a generally convex shaped portion forming suction side 28.

The cooling channel 14, as shown in FIG. 4, may be positioned in inner aspects of the blade 20 for directing one or more gases, which may include air received from a compressor (not shown), through the blade 18 and out one or more orifices 30 in the blade 18 to reduce the temperature of the blade 18. As shown in FIG. 3, the orifices 30 may be positioned in a tip 32, a leading edge 34, or a trailing edge 36, or any combination thereof, and have various configurations. The channel 14 may be arranged in various configurations, and the cooling system 10 is not limited to a particular flow path.

The cooling system 10, as shown in FIG. 4, may be formed from a cooling channel 14, such as a serpentine cooling channel for directing cooling fluids through the turbine blade 12 to remove excess heat to prevent premature failure. A flow guide 11 may be positioned within the cooling channel 14 to enhance the flow of cooling fluids through the cooling channel 14. In the embodiment shown in FIG. 4, the flow guide 11 may be used to enhance the flow of cooling fluids through a first turn 38, a mid-chord region 13, and a second turn 40, which may be referred to as a root turn.

In the embodiment shown in FIG. 4, the first turn 38 of the cooling channel 14 is positioned proximate to the tip 32, and the second turn 40 is a blade root turn 15 positioned proximate to the root 20 and platform 22. The flow guide 11 may extend from the first turn 38 of the channel 14 to a second turn 40 of the channel 14. A first turn section 42 of the flow guide 11 may be positioned in the first turn 38 of the channel 14, and a second turn section 44 of the flow guide 11 may be positioned in the second turn 40. A body 45 of the flow guide 11 may be positioned between the first and second turn sections 42, 44 and in the mid-chord region 13 of the turbine blade 12. The body 45 may couple the first and second turn sections 42, 44 together. The flow guide 11 may also extend from a first inner surface 56 forming a portion of the cooling system 10 to a second inner surface 58 generally opposite the first inner surface 56.

In at least one embodiment, as shown in FIG. 4, the first turn section 42 of the flow guide 11 may include a leading end 46 that may extend closer to the leading edge 34 of the turbine blade 12 than a first rib 48. Similarly, the second turn section 44 of the flow guide 11 may include a trailing end 50 that may extend closer to the trailing edge 36 of the turbine blade 12 than a second rib 52. The first turn section 42 may extend generally parallel to the tip 32 of the blade 12 and include a radius portion 54 that couples the first turn section 42 to the flow guide body 45. The second turn section 44 may be formed in the shape of a quarter-circle in at least one embodiment. In at least one embodiment, the flow guide 11 may be positioned in the cooling channel 14 generally equidistant from the first and second ribs 48, 52 forming the cooling channel 14.

The cooling channel 14 may or may not include protrusions 64, which may also be referred to as trip strips or turbulators, extending from surfaces forming the chamber 14 for increasing the efficiency of the cooling system 10. The protrusions 64 prevent or greatly limit the formation of a boundary layer of cooling fluids proximate to the surfaces forming the cooling channel 14. The protrusions 64 may or may not be positioned generally parallel to each other and may or may not be positioned equidistant from each other throughout the cooling channel 14. The protrusions 64 may be aligned at an angle greater than zero relative to a general direction of cooling fluid flow through the cooling system 10. The protrusions 64 may also be aligned generally orthogonal to the flow of cooling fluids through the cooling channel. In at least one embodiment, there exist a plurality of protrusions 64 positioned throughout the cooling channel 14.

The cooling channel 14 may also include a contaminant release orifice 66 at the tip 32 for releasing contaminants that may be in the cooling fluids flowing from the root 20. The contaminant release orifice 66 may have any appropriate size.

During operation, cooling fluids flow into the cooling system 10 from the root 20. At least a portion of the cooling fluids enter the cooling channel 14 and pass through an outflow section 60 of the cooling channel 14 at a high flow velocity, thereby generating a high internal heat transfer coefficient and impingement. The cooling flow is then divided into two flow streams as the cooling fluids encounter the leading end 46 of the flow guide 11. A portion of the cooling fluids accelerates and enters the outer flow path 62 and impinges on the inner surface of the blade tip. The cooling fluids also impinge onto the inner surface of the blade tip near the trailing edge of the blade before flowing in the direction of the blade root. The outer flow path 62 may receive a disproportionately larger amount of the cooling fluids, which causes corners in the first turn 38 to receive more cooling fluids. The flow guide 11 eliminates the cooling fluid separation problem that exists in conventional cooling channels and effectively cools the first turn 38 of the cooling channel 14. The combination of reduced fluid flow separation and the impingement cooling greatly increase the cooling in the tip 32 of the blade 12.

The cooling fluids flow on either side of the flow guide 11 through the mid-chord region 13 of the cooling channel 14. The flow guide 11 provides support to the mid-chord region 13 while directing the cooling fluids to the second turn 40. As the cooling fluids enter the second turn 40, the configuration of the flow guide in the root turn 15 provides a smooth cooling flow for a large root turn, thereby reducing the root section turn loss.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, a tip at a first end, a root coupled to the blade at an end generally opposite the first end for supporting the blade and for coupling the blade to a disc, and at least one serpentine cooling channel forming a cooling system in the blade;

wherein the at least one serpentine cooling channel extends from the leading edge to the trail edge and receives cooling fluids from the root proximate to the leading edge and passes the cooling fluids toward the tailing edge;

at least one flow guide positioned in the serpentine cooling channel and extending from a first turn of the serpentine channel to a second turn of the serpentine channel, wherein the flow guide includes a first turn section in the first turn of the serpentine cooling channel, a second turn section in the second turn of the serpentine cooling channel, and a flow guide body extending from the first turn section to the second turn section;

wherein the first turn section is positioned proximate to the leading edge and the tip of the generally elongated blade separating a leading edge exit flow of cooling fluids into two channels and extends generally parallel to the tip of generally elongated blade for impinging cooling fluids onto an inner surface of the tip and minimizing cooling fluid separation.

2. The turbine blade of claim 1, wherein the at least one serpentine cooling channel extends from proximate the root of the blade to a position proximate to the tip.

3. The turbine blade of claim 1, wherein the first turn section of the flow guide includes a radius portion that couples the first turn section to the flow guide body.

4. The turbine blade of claim 1, wherein the first turn section of the flow guide has a leading end that is positioned in the first turn closer to the leading edge of the blade than a first rib forming the serpentine cooling channel.

5. The turbine blade of claim 1, wherein the second turn section of the flow guide is formed in the shape of a quarter-circle.

6. The turbine blade of claim 1, wherein the at least one flow guide extends from a first inner surface forming the serpentine cooling channel to a second inner surface forming the serpentine cooling channel that is generally opposite to the first inner surface.

7. The turbine blade of claim 1, wherein the second turn section comprises a trailing end of the flow guide that extends into the second turn such that the trailing end of the flow guide is closer to the trailing edge of the blade than a second rib forming the serpentine cooling channel.

8. The turbine blade of claim 1, wherein the flow guide is positioned generally equidistant between the first and second ribs forming the serpentine cooling channel.

9. The turbine blade of claim 1, wherein the serpentine cooling channel is triple pass serpentine cooling system.

10. The turbine blade of claim 1, further comprising a plurality of protrusions protruding from a surface forming the at least one serpentine cooling channel and comprising a contaminant release orifice in the blade tip.

11. A turbine blade, comprising:

a generally elongated blade having a leading edge, a trailing edge, a tip at a first end, a root coupled to the blade at an end generally opposite the first end for supporting the blade and for coupling the blade to a disc, and at least one serpentine cooling channel forming a cooling system in the blade and extending from proximate the root of the blade to a position proximate to the tip;

wherein the at least one serpentine cooling channel extends from the leading edge to the trail edge and receives cooling fluids from the root proximate to the leading edge and passes the cooling fluids toward the trailing edge;

at least one flow guide positioned in the serpentine cooling channel and extending from a first turn of the serpentine channel to a second turn of the serpentine channel, wherein the flow guide includes a first turn section in the first turn of the serpentine cooling channel, a second turn section in the second turn of the serpentine cooling channel, and a flow guide body extending from the first turn section to the second turn section;

wherein the first turn section of the flow guide has a leading end that is positioned in the first turn closer to the leading edge of the blade than a first rib forming the serpentine cooling channel;

wherein the first turn section is positioned proximate to the leadins edge and the tip of the generally elongated blade separating a leading edge exit flow of cooling fluids into two channels, extends generally parallel to the tip of generally elongated blade for impinging cooling fluids onto an inner surface of the tip and minimizing cooling fluid separation and includes a radius portion that couples the first turn section to the flow guide body; and wherein the second turn section comprises a trailing end of the flow guide that extends into the second turn such that the trailing end of the flow guide is closer to the trailing edge of the blade than a second rib forming the serpentine cooling channel.

12. The turbine blade of claim 11, wherein the second turn section of the flow guide is formed in the shape of a quarter-circle.

13. The turbine blade of claim 11, wherein the at least one flow guide extends from a first inner surface forming the serpentine cooling channel to a second inner surface forming the serpentine cooling channel that is generally opposite to the first inner surface.

14. The turbine blade of claim 11, wherein the flow guide is positioned generally equidistant between the first and second ribs forming the serpentine cooling channel.

15. The turbine blade of claim 11, wherein the serpentine cooling channel is triple pass serpentine cooling system.

16. The turbine blade of claim 11, further comprising at least one first protrusion protruding from a surface forming the at least one serpentine cooling channel and comprising a contaminant release orifice in the blade tip.

17. A turbine blade, comprising:

a generally elongated blade having a leading edge, a trailing edge, a tip at a first end, a root coupled to the blade at an end generally opposite the first end for supporting the blade and for coupling the blade to a disc, and at least one triple pass serpentine cooling channel forming a cooling system in the blade and extending from proximate the root of the blade to a position proximate to the tip;

at least one flow guide positioned in the serpentine cooling channel and extending from a first turn of the serpentine channel to a second turn of the serpentine channel, wherein the flow guide includes a first turn section in the first turn of the serpentine cooling channel, a second turn section in the second turn of the serpentine cooling channel, and a flow guide body extending from the first turn section to the second turn section;

at least one first protrusion protruding from a surface forming the at least one cooling channel;

a contaminant release orifice in the blade tip;

wherein the first turn section of the flow guide extends generally parallel to the tip of the blade, includes a radius portion that couples the first turn section to the flow guide body, and has a leading end that is positioned in the first turn closer to the leading edge of the blade than a first rib forming the serpentine cooling channel; and wherein the second turn section is formed in the shape of a quarter-circle and comprises a trailing end of the flow guide that extends into the second turn such that the trailing end of the flow guide is closer to the trailing edge of the blade than a second rib forming the serpentine cooling channel.

18. The turbine blade of claim 17, wherein the at least one flow guide extends from a first inner surface forming the serpentine cooling channel to a second inner surface forming the serpentine cooling channel that is generally opposite to the first inner surface.

19. The turbine blade of claim 17, wherein the flow guide is positioned generally equidistant between the first and second ribs forming the serpentine cooling channel.

* * * * *